US005697403A

United States Patent [19]

Onishi et al.

[11] Patent Number: 5,697,403

[45] Date of Patent: Dec. 16, 1997

[54] DENITRIFICATION SYSTEM

[75] Inventors: Toshiyuki Onishi; Atsushi Morii; Shigeyuki Nishijima, all of Nagasaki, Japan

[73] Assignee: Mitsubishi Jukogyo Kabushiki Kaisha, Tokyo, Japan

[21] Appl. No.: 271,513

[22] Filed: Jul. 7, 1994

[30] Foreign Application Priority Data

Jul. 12, 1993 [JP] Japan ..... 5-037917 U

[51] Int. Cl.[6] ..... F23J 15/00

[52] U.S. Cl. ..... 138/37; 138/45; 138/46; 366/340; 454/315

[58] Field of Search ..... 138/37, 39, 45, 138/46, 44; 366/340, 336, 337; 454/309, 313, 315; 137/625.28; 251/127, 298

[56] References Cited

U.S. PATENT DOCUMENTS

| | | | |
|---|---|---|---|
| 2,393,170 | 1/1946 | Kinney et al. | 138/37 |
| 2,667,185 | 1/1954 | Beavers | 138/37 |
| 3,145,642 | 8/1964 | Radcliff | 454/315 X |
| 4,224,826 | 9/1980 | McLaughlin et al. | 138/37 X |
| 4,238,455 | 12/1980 | Ogiwara | 422/171 |
| 4,487,510 | 12/1984 | Buurman et al. | 138/37 X |
| 4,506,991 | 3/1985 | Hudson | 366/336 X |
| 4,726,563 | 2/1988 | Inglis | 251/127 |
| 4,887,522 | 12/1989 | Kuno et al. | 138/39 X |
| 5,226,213 | 7/1993 | Lewis et al. | 138/37 X |
| 5,364,303 | 11/1994 | Terry | 454/315 X |

FOREIGN PATENT DOCUMENTS

| | | | |
|---|---|---|---|
| A-0502220 | 9/1992 | European Pat. Off. . | |
| 4-8619685 | 4/1986 | Germany . | |
| A-3526575 | 5/1987 | Germany . | |
| A-3637395 | 5/1988 | Germany . | |
| 63-210551 A | 8/1988 | Japan | 454/319 |

*Primary Examiner*—Patrick Brinson
*Attorney, Agent, or Firm*—Fish & Richardson P.C.

[57] ABSTRACT

The object of the present invention is to provide a device to make flow uniform in a denitrification system, which can achieve a predetermined flow regulation effect with low pressure loss independently of the gas flow rate. According to the present invention, the device installed on the upstream side of a chemical injection means for the denitrification system is composed of at least one perforated plate 11, and the perforated plate 11 can be turned by a rotating shaft 10 or 10*a* from the closed position where the gas flow path is closed to the open position where the gas flow path is opened or vice versa.

4 Claims, 2 Drawing Sheets

DENITRIFICATION SYSTEM

FIELD OF THE INVENTION AND RELATED ART STATEMENT

The present invention relates to a device to make flow uniform used in an exhaust gas denitrification system.

The conventional boiler is provided with a denitrification system to remove nitrogen oxides ($NO_x$) in exhaust gas. In this denitrification system, an $NO_x$ removal catalyst is contained. An ammonia injection nozzle for injecting ammonia ($NH_3$) is provided on the upstream side of the denitrification system, and a device to make flow uniform for regulating the flow of exhaust gas is provided on the upstream side of the ammonia injection nozzle.

The aforementioned device to make flow uniform, consisting of a number of steel members etc. having a chevron-shaped cross section which are fixedly arranged in parallel or in a lattice shape in the exhaust gas flow path, achieves flow uniform effect only for a predetermined gas flow property.

In the aforementioned device to make flow uniform, because the flow uniform lattice etc. is fixed, the shape of the lattice is such that the boiler is adapted to the exhaust gas flow rate at base load (high load). Therefore, the flow uniform effect cannot be achieved sufficiently for a low exhaust gas flow rate at partial loads. If the device to make flow uniform is constructed so as to achieve the flow regulation effect at partial loads, the pressure loss becomes excessive at high loads.

OBJECT AND SUMMARY OF THE INVENTION

An object of the present invention is to provide a device to make flow uniform in a denitrification system which can solve the above problems.

The device to make flow uniform in a denitrification system in accordance with the present invention, which is installed on the upstream side of a chemical injection means for the denitrification system, is composed of at least one perforated plate arranged across the gas flow, and the perforated plate can be turned from the closed position where the gas flow path is closed to the open position where the gas flow path is opened or vice versa.

According to the present invention, when the load is low and in turn the gas flow rate is low, the perforated plate arranged across the gas flow is turned to close the gas flow path. Therefore, the gas flows through the holes in the perforated plate, so that a predetermined flow uniform is achieved. On the other hand, when the load is high, the perforated plate is turned to open the flow path, which maintains the predetermined flow regulation effect and prevents the increase in pressure loss.

DETAILED DESCRIPTION OF PREFERRED EMBODIMENTS

Figure 2:
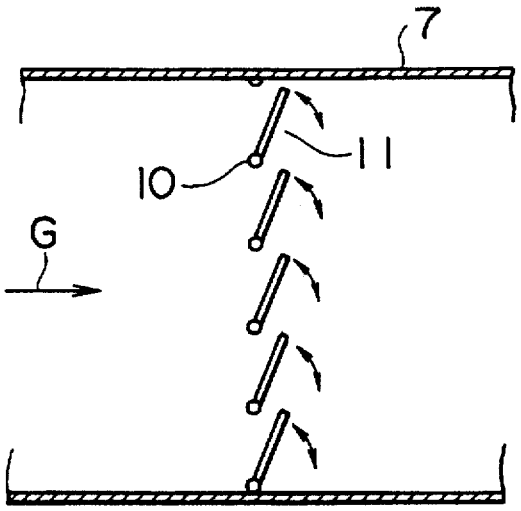
FIG. 2 is a sectional view showing an example of positions at which rotating shafts are disposed, in the embodiment.
Figure 3:
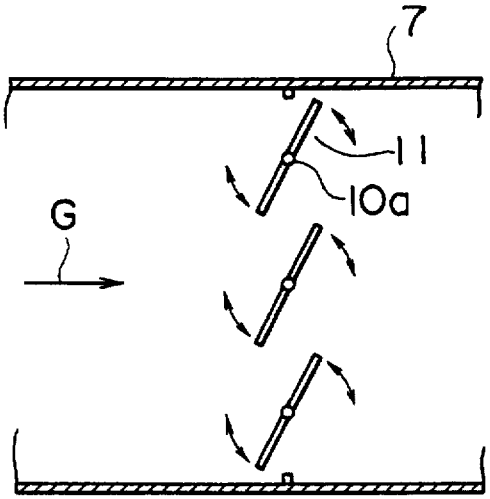
FIG. 3 is a sectional view showing another example of positions at which rotating shafts are disposed, in the embodiment.
Figure 4:
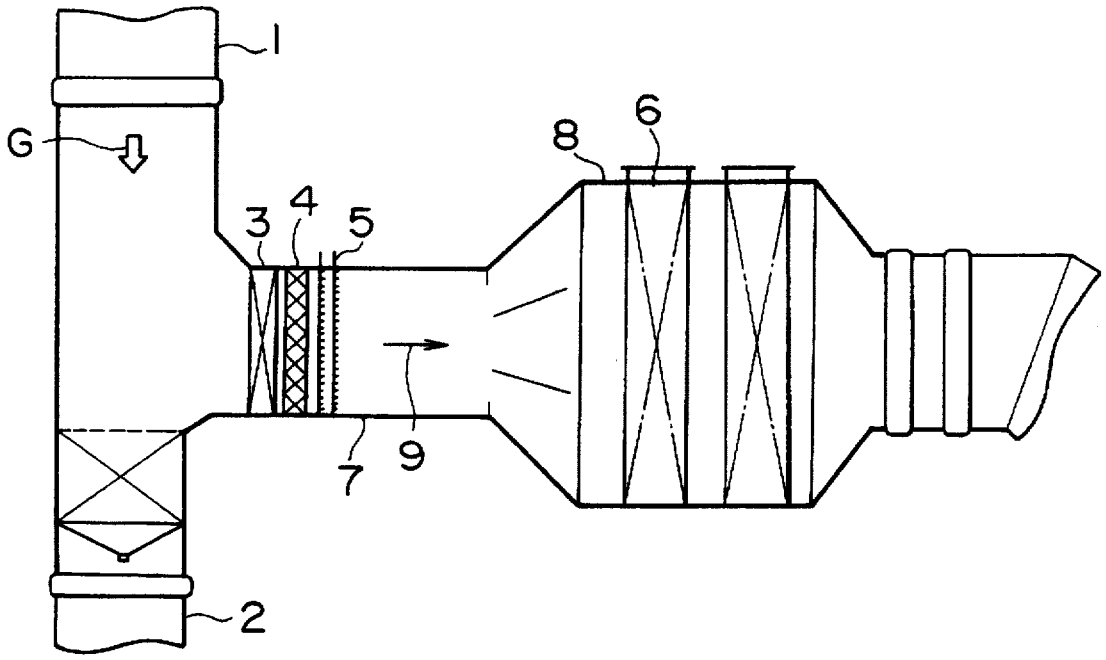
FIG. 4 is a general view showing an example of a denitrification system incorporating the embodiment.

One embodiment of the present invention will be described with reference to FIGS. 1 through 4. The device to make flow uniform in accordance with this embodiment is incorporated between a boiler outlet duct and a denitrification system, for example, as shown in FIG. 4. In the example shown in FIG. 4, the device 3 to make flow uniform is installed on the upstream side of an $NH_3$ injection nozzle 5.

As shown in FIG. 4, the denitrification system is so constructed that an denitrification reactor 8, in which plural rows of $NO_x$ removal catalysts 6 are arranged, is installed to an exhaust gas duct 7 connected to a fuel economizer outlet duct 1 of a boiler etc. (not shown), and exhaust gas 9 containing nitrogen oxides ($NO_x$) flows therethrough. On the upstream side of the denitrification reactor 8, a static device 4 to make flow uniform of a well-known construction and an ammonia injection nozzle 5 are installed. The device 3 to make flow uniform in accordance with the present invention is installed on the upstream side of these elements. Reference numeral 2 denotes an exhaust gas recycling duct connected to the fuel economizer outlet duct 1. The static device 4 to make flow uniform can be omitted.

Figure 1:
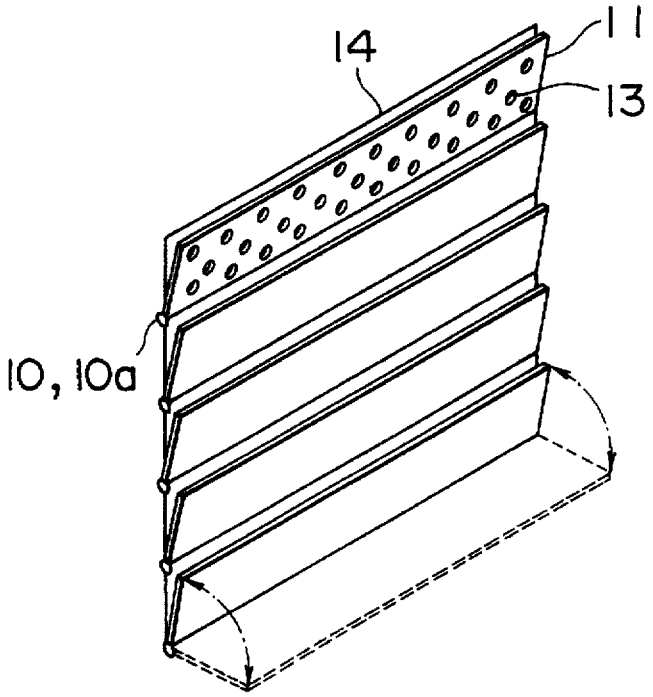
FIG. 1 is a perspective view of one embodiment of the present invention.

The details of the device to make flow uniform in accordance with this embodiment will be described with reference to FIGS. 1 through 3. The exhaust gas duct 7 is arranged substantially in a horizontal position and its cross section is, for example, rectangular. A plurality of perforated plates 11 are arranged vertically across the flow of exhaust gas G in the rectangular exhaust gas duct 7, and many through holes 13 are formed in the perforated plate 11. The size and number of the hole 13 is determined depending on the exhaust gas flow rate etc. Each perforated plate 11 is formed into a rectangular blade shape having one side substantially equal to the width of the exhaust gas duct 7. For the perforated plate 11, its lower edge is installed to a rotating shaft 10 arranged horizontally across the flow of exhaust gas G indicated by the arrow as shown in FIG. 2, or its center in the vertical direction is installed to a rotating shaft 10*a* arranged horizontally across the flow of exhaust gas G indicated by the arrow as shown in FIG. 3. The dumper-shaped device to make flow uniform is constructed in such a manner. The size and arrangement of the perforated plates are set so that when the perforated plates 11 are turned by the rotating shaft 10 or 10*a* and positioned vertically, the edge of the perforated plate 11 comes into contact with the edge of the adjacent perforated plate or the exhaust gas duct 7 so that the perforated plates come into a closed position where the exhaust gas flow path is closed (see FIG. 1). The rotating shafts 10, to which respective perforated plates are installed, turn synchronously to the same angle in the same direction by a mechanism (not shown). Reference numeral 14 denotes a frame supporting the rotating shafts.

In this embodiment having the above configuration, when the load is low and the exhaust gas flow rate is low, the perforated plates assume the closed positions where the exhaust gas flow path is closed by the rotation of the rotating shafts 10 or 10*a*. The exhaust gas of a low flow rate passes through many holes 13 in the perforated plates so that the predetermined flow regulation effect can be achieved. The solid line in FIG. 1 indicates the closed position, while the broken line the open position.

When the load increases and in turn the exhaust gas flow rate increases, the perforated plates 11 are accordingly turned by the rotation of the rotating shafts 10 to open the exhaust gas flow path. Thus, a cross-sectional area of the exhaust gas flow path is provided in accordance with the exhaust gas flow rate, so that the flow regulation effect can be achieved without pressure loss.

In the case where the device to make flow uniform of this embodiment is arranged in a denitrification system as shown in FIG. 4, when the load is high and in turn the exhaust gas flow rate is high, the device 3 to make flow uniform is opened and gas flow is unifying by the static device 4 to make flow uniform installed in the downstream. As a result, the distribution of gas flow velocity at the cross section of the ammonia injection nozzle 5 is within the average value ±30%, and the gas flow regulation effect can be achieved with low pressure loss due to the device 3 to make flow uniform.

When the load is low and in turn the exhaust gas flow rate is low, the flow uniform effect of the static device 4 to make flow uniform is little, and when the device 3 to make flow uniform is absent, the distribution of flow velocity at the cross section of the ammonia injection nozzle 5 increases to the average value ±80%, resulting in an decrease in denitrification property. When the device 3 to make flow uniform is installed and opened, the distribution of gas flow velocity at the cross section of the ammonia injection nozzle 5 becomes ±40%. Thus, the distribution of gas flow velocity can significantly be improved as compared with the case where the device to make flow uniform is not installed.

Although a plurality of perforated plates have been used in the above-described embodiment, one perforated plate may be used in the present invention. Also, in the above-described embodiment, the plural perforated plates have been arranged vertically at right angles to the horizontal exhaust gas duct. However, these plates may be arranged at an angle with respect to the vertical direction.

The present invention achieves the predetermined flow uniform effect with low pressure loss by turning the perforated plates, which are arranged across the gas flow, in accordance with the gas flow rate.

We claim:

1. A denitrification system for exhaust gas comprising:

a chemical injector; and a gas flow adjusting device, said device arranged upstream of said injector so as to control the gas flow to said injector, said device including at least one plate with perforations, said plate having open and closed positions, said plate being rotatable between said closed position wherein said gas flow is substantially only through said perforations in said plate and said open position wherein said gas flow is not substantially restricted by said plate.

2. The denitrification system of claim 1, wherein the lower edge of said perforated plate is installed on a rotating shaft extending transversely to the gas flow direction.

3. The denitrification system of claim 1, wherein said plate rotates about an axis substantially through its center.

4. The denitrification system of claim 1, wherein a stationary gas flow adjuster is provided between said chemical injector and said gas flow adjusting device.

* * * * *